United States Patent [19]

Libicky et al.

[11] Patent Number: 4,546,069

[45] Date of Patent: Oct. 8, 1985

[54] METHOD FOR PROCESSING PHOTOGRAPHIC SILVER DYE BLEACH MATERIALS

[75] Inventors: Arnost Libicky; Meinrad Schär, both of Marly, Switzerland

[73] Assignee: Ciba-Geigy AG, Basel, Switzerland

[21] Appl. No.: 632,087

[22] Filed: Jul. 18, 1984

[30] Foreign Application Priority Data

Jul. 20, 1983 [CH] Switzerland ..... 3990/83

[51] Int. Cl.[4] ..... G03C 7/00; G03C 5/44

[52] U.S. Cl. ..... 430/390; 430/392; 430/393; 430/450; 430/461; 430/462; 430/465; 430/466; 430/483; 430/485; 430/489; 430/493

[58] Field of Search ..... 430/390, 392, 393, 450, 430/465, 466, 483, 485, 489, 493, 461, 462

[56] References Cited

U.S. PATENT DOCUMENTS

| | | | |
|---|---|---|---|
| 2,507,183 | 5/1950 | Wilder et al. | 430/161 |
| 2,564,238 | 1/1951 | Sprung | 430/390 |
| 3,259,497 | 7/1966 | Wartburg | 430/393 |
| 3,414,411 | 12/1968 | Michel et al. | 430/392 |
| 3,969,492 | 6/1976 | Witte et al. | 423/262 |
| 4,014,698 | 3/1977 | Martmaler | 430/392 |
| 4,125,402 | 11/1978 | Mollet | 430/462 X |
| 4,138,256 | 2/1979 | Chylewski et al. | 430/392 |
| 4,186,008 | 1/1980 | Schar et al. | 430/393 |
| 4,304,846 | 12/1981 | Marthaler et al. | 430/392 |

FOREIGN PATENT DOCUMENTS

| | | |
|---|---|---|
| 2,616,638 | 10/1976 | Fed Rep of Germany |
| 14,688 | 8/1980 | European Pat. Off. |
| 1,504,238 | 10/1967 | France. |
| 1,541,483 | 8/1968 | France. |
| 2,169,779 | 11/1973 | France. |

OTHER PUBLICATIONS

Patents Abstracts of Japan, Vol. 7, No. 172 (p. 213), (1317).

*Primary Examiner*—Alexander S. Thomas
*Assistant Examiner*—Mukund J. Shah
*Attorney, Agent, or Firm*—Joseph G. Kolodny

[57] ABSTRACT

The processing time of exposed photographic silver dye bleach materials is shortened by using a bleach preparation which contains a strong acid, a water-soluble iodide, a water-soluble organic nitro compound, an anti-oxidizing agent, a bleach catalyst, an organic photographic developing agent and/or a benzotriazole derivate.

22 Claims, No Drawings

METHOD FOR PROCESSING PHOTOGRAPHIC SILVER DYE BLEACH MATERIALS

The present invention relates to a method for processing photographic silver dye bleach materials.

Methods for processing silver dye bleach materials by the process steps of silver development, dye and silver bleaching and fixing have been disclosed, for example by DE-A No. 2,530,469. Moreover, DE-A No. 2,716,136 describes a method, according to which the duration of the dye and silver bleach can be shortened by the addition of quarternary ammonium salts to the bleach bath. The dye and silver bleach can also be shortened in the presence of water-soluble phosphines. This has been disclosed by DE-A No. 2,651,969.

These methods are in fact well suited for the processing of silver dye bleach materials. It has been found, however, that a further shortening of the processing time, in particular of the combined dye and silver bleach is desirable, for example in automatic printing apparatus and automatic photo-booths.

It is therefore the object of the present invention to provide a method for processing exposed silver dye bleach materials, which enables photographic images to be produced within a shorter time.

Surprisingly, it has now been found that the presence of certain organic developing agents in bleach baths can lead to an enhancement of the dye and silver bleaching. This is in contrast to the principle, otherwise conventional in photography, of keeping bleach baths free of developer substances.

One subject of the present invention is therefore a method for processing exposed silver dye bleach materials by the process steps of silver development, dye and silver bleaching, and fixing, which comprises using, for the combined dye and silver bleach, a preparation which contains (a) a strong acid, (b) a water-soluble iodide, (c) a water-soluble organic nitro compound, (d) an anti-oxidising agent, (e) a bleach catalyst and (f) an organic developing agent and/or a benzotriazole derivative.

Further subjects of the present invention are the preparations for carrying out the dye and silver bleach, and packaging units for these preparations in the form of liquid, pasty or pulverulent concentrates.

The strong acids (a) used for the dye and silver bleach in the preparation according to the invention are intended to establish a pH value of at most 2 in this preparation. Preferably, sulfuric acid or sulfamic acid, or other strong acids, for example phosphoric acid, are used.

The water-soluble iodide (b) is preferably sodium iodide or potassium iodide.

Examples of suitable water-soluble organic nitro compounds (c) are aromatic nitro compounds, for example nitrobenzenesulfonic acids, such as o- or m-nitrobenzenesulfonic acid, 2,4- or 3,5-dinitrobenzenesulfonic acid, 2-chloro-5-nitrobenzenesulfonic acid, 4-methyl-3,5-dinitrobenzenesulfonic acid, 3-chloro-2,5-dinitrobenzenesulfonic acid, 2-amino-4-nitrobenzenesulfonic acid and 2-amino-4-nitro-5-methoxybenzenesulfonic acid.

The anti-oxidising agents (d) used are mainly reductones or mercapto compounds. Suitable reductions are in particular aci-reductones having a 3-carbonyl-ene-1,2-diol grouping, such as reductone, triose reductone or preferably ascorbic acid. The preferred mercapto compounds are mercaptocarboxylic acids, in particular those of the formula $HS-(CH_2)_m-COOH$, in which m is 3 or 4. The mercapto compounds can also be added in the corresponding thioketo and/or thiolactone form.

The bleach catalysts (e) are especially those from the class of diazine compounds. For example, pyrazines or especially quinoxalines can be used. Those quinoxalines are suitable above all which are substituted by, for example, methyl, methoxy, (acylated) hydroxymethyl or (acylated) amino groups.

Preferably, the quinoxalines used are thus of the formula

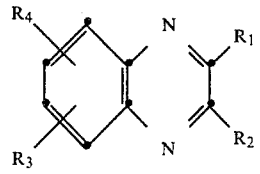

(1)

in which $R_1$ and $R_2$ independently of one another are hydrogen, alkyl having 1 to 5 carbon atoms, a radical of the formula $—CH_2—X$, in which X is hydroxyl, halogen, acyloxy or alkoxy having 1 to 4 carbon atoms, or phenyl, and $R_3$ and $R_4$ independently of one another are hydrogen, alkyl having 1 to 5 carbon atoms, alkoxy having 1 to 4 carbon atoms, hydroxyl, halogen, amino, acylamino or a sulfonic acid group or together form a radical of the formula $—O—(CH^2)_p—O—$ in which p is 1 to 2.

Those quinoxalines of the formula (1) are particularly suitable which are of the formula

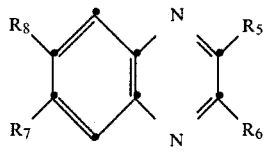

(2)

or

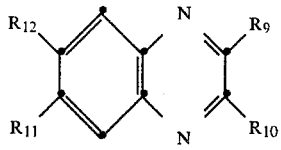

(3)

in which $R_5$ and $R_6$ independently of one another are alkyl having 1 to 5 carbon atoms, $—CH_2OH$, $—CH_2Cl$ or phenyl, and $R_7$ and $R_8$ independently of one another are hydrogen, alkyl having 1 to 5 carbon atoms, alkoxy having 1 to 4 carbon atoms, hydroxyl or amino, and $R_9$ and $R_{10}$ are alkyl having 1 to 5 carbon atoms, and $R_{11}$ and $R_{12}$ independently of one another are hydrogen, alkyl having 1 to 5 carbon atoms or hydroxyl.

A number of particularly effective bleach catalysts are listed in Table 1 which follows.

TABLE 1

Quinoxalines of the formula (1)

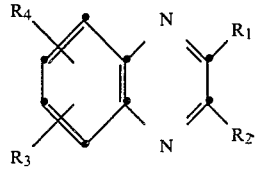

| $R_1$ | $R_2$ | $R_3$ | $R_4$ |
|---|---|---|---|
| $-CH_3$ | $-CH(OH)-CH_3$ | $-H$ | $-H$ |
| $-CH_2OH$ | $-CH_2OH$ | 6-$OCH_3$ | 7-$NH-CO-CH_3$ |
| $-CH_2O-COCH_3$ | $-CH_2O-COCH_3$ | 6-$OCH_3$ | 7-$NH-CO-CH_3$ |
| $-CH_2Cl$ | $-CH_2Cl$ | 6-OH | $-H$ |
| $-CH_2OH$ | $-CH_2OH$ | 6-$OCH_3$ | 7-$NH_2$ |
| $-CH_2OH$ | $-CH_2OH$ | 5-$OCH_3$ | 6-Cl |
| $-CH_2OH$ | $-CH_2OH$ | 5-Cl | 6-$OCH_3$ |
| $-CH_2O-COCH_3$ | $-CH_2O-COCH_3$ | 5-$OCH_3$ | 6-$OCH_3$ |
| $-CH_2O-COCH_3$ | $-CH_2O-COCH_3$ | 5-Cl | 6-$OCH_3$ |
| $-CH_3$ | $-CH_3$ | 5,6-$O-CH_2-O-$ | |
| $-CH_2OH$ | $-CH_2OH$ | 6,7-$O-CH_2-CH_2-O-$ | |
| $-CH_2OC_2H_5$ | $-CH_2OC_2H_5$ | 6-$OCH_3$ | $-H$ |
| $-CH_2OCH_3$ | $-CH_2-OCH_3$ | $-H$ | $-H$ |
| $-CH_2OH$ | $-CH_2OH$ | 5-$OCH_3$ | $-H$ |
| $-CH_2OH$ | $-CH_2OH$ | 6-$OCH_3$ | $-H$ |
| $-CH_2OH$ | $-CH_2OH$ | 6-$OCH_3$ | 7-$OCH_3$ |
| $-CH_2OH$ | $-CH_2OH$ | $-H$ | $-H$ |
| $-CH_2O-COCH_3$ | $-CH_2O-COCH_3$ | 5-$OCH_3$ | $-H$ |
| $-CH_2O-COCH_3$ | $-CH_2O-COCH_3$ | 6-$OCH_3$ | $-H$ |
| $-CH_2O-COCH_3$ | $-CH_2O-COCH_3$ | 6-$OCH_3$ | 7-$OCH_3$ |
| $-C_6H_5$ | $-C_6H_5$ | 6-$SO_3H$ | $-H$ |
| $-CH_3$ | $-CH_3$ | 5-$OCH_3$ | 8-$CH_3$ |
| $-CH_2O-COCH_3$ | $-CH_2O-COCH_3$ | $-H$ | $-H$ |
| $-CH_3$ | $-CH_3$ | 6,7-$O-CH_2-CH_2O-$ | |
| $-CH_2OH$ | $-CH_2OH$ | 6,7-$O-CH_2O-$ | |
| $-CH_3$ | $-CH_3$ | $-CH_3$ | $-CH_3$ |
| $-CH_3$ | $-CH_3$ | 6-Cl | $-H$ |
| $-CH_3$ | $-CH_3$ | 5-OH | $-H$ |
| $-CH_3$ | $-CH_3$ | 5-OH | 8-OH |
| $-CH_2O-COCH_3$ | $-CH_2O-COCH_3$ | 6,7-$O-CH_2-CH_2-O-$ | |
| $-CH_2O-COCH_3$ | $-CH_2O-COCH_3$ | 6,7-$O-CH_2-O-$ | |
| $-CH_3$ | $-CH_3$ | 6-COOH | $-H$ |
| $-CH_3$ | $-CH_3$ | 6-$OCH_3$ | 8-$OCH_3$ |
| $-CH_3$ | $-CH_3$ | $-H$ | $-H$ |
| $-CH_3$ | $-CH_3$ | $-CH_3$ | $-H$ |
| $-CH_3$ | $-CH_3$ | 6-$OCH_3$ | $-H$ |
| $-CH_3$ | $-CH_3$ | 6-OH | $-H$ |
| $-CH_3$ | $-CH_3$ | 6-$SO_3H$ | $-H$ |

The component (f), the use of which in bleach baths is novel and essential to the invention, is an organic developer substance conventional in photography, for example a hydroquinone derivative or pyrazolidinone derivative. Particularly suitable derivatives are those of the formulae

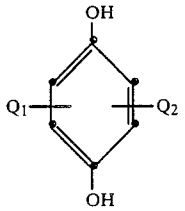

(4)

and

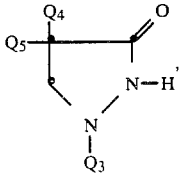

(5)

in which $Q_1$ and $Q_2$ independently of one another are hydrogen, alkyl or alkoxy each having 1 to 4 carbon atoms, preferably methyl, methoxy, ethyl, ethoxy, propyl, butyl, butoxy or tert.-butyl, or halogen, preferably chlorine or bromine, $Q_3$ is phenyl or phenyl substituted; by alkyl or alkoxy each having 1 to 4 carbon atoms, for example methyl, ethyl, propyl or butyl, or by methoxy or ethoxy, and $Q_4$ and $Q_5$ independently of one another are hydrogen, alkyl or hydroxyalkyl each having 1 to 4 carbon atoms, for example (hydroxy-)methyl, (hydroxy-)ethyl, (hydroxy-)propyl or (hydroxy-)butyl. Preferably, $Q_3$ is phenyl, and $Q_4$ and $Q_5$ independently of one another are preferably hydrogen, methyl or hydroxymethyl.

Particularly suitable pyrazolidinone derivatives are 1-phenylpyrazolidinone, 1-phenyl-4-methyl-4'-hydroxymethylpyrazolidinone and 1-phenyl-4-methylpyrazolidinone.

Particularly suitable developing agents of the hydroquinone type are, in addition to hydroquinone itself, 2-chlorohydroquinone, 2-methylhydroquinone, 2-bromohydroquinone, 2,3-dichlorohydroquinone, 2,3-dimethylhydroquinone, 2,5-dimethylhydroquinone, 2,5-diethylhydroquinone, 2,5-dimethoxyhydroquinone, 2,5-dibromohydroquinone, 2,6-dimethylhydroquinone, 2-methyl-5-tert.butylhydroquinone and 2-methyl-3-chlorohydroquinone.

Benzotriazole derivatives of the formula

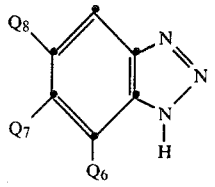

(6)

in which $Q_6$ is hydrogen or alkyl having 1 to 4 carbon atoms, $Q_7$ is hydrogen, alkyl or alkoxy each having 1 to 4 carbon atoms, $—SO_3H$ or $—SO_2NH_2$, and $Q_8$ is hydrogen, alkyl having 1 to 4 carbon atoms or halogen, can also be used as the component (f).

Preferably, in the compounds of the formula (6), $Q_6$ is hydrogen or methyl, $Q_7$ is hydrogen, methyl, methoxy or amidosulfonyl and $Q_8$ is hydrogen, methyl or chlorine.

Benzotriazole itself is very particularly suitable, and this is also true of, for example, 4-methyl- and 5-methylbenzotriazole, 5,6-dimethylbenzotriazole, 5-methyl-6-chlorobenzotriazole and 5-sulfobenzotriazole.

The benzotriazole derivatives and the organic developer substances mentioned can also be used together as the component (f).

The preparation for combined dye and silver bleach can, additionally to the components (a) to (f) mentioned, contain a quarternary ammonium salt as the component (g). Preferably, this is of the formulae

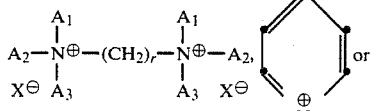

(7)

(8)

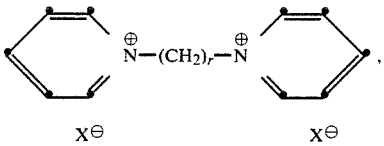

(9)

in which $A_1$, $A_2$ and $A_3$ independently of one another are alkyl having 1 to 4 carbon atoms in each case, for example methyl, ethyl, propyl or butyl, $A_4$ is (hydroxy-)methyl or (hydroxy-)ethyl, $X^{\ominus}$ is a halide, preferably chloride or bromide, and r is 2 to 12. The pyridinium compounds of the formula (8), in particular hydroxyethyl-pyridinium chloride, are particularly suitable.

The preparation according to the invention can contain a mixture of several bleach catalysts (e), organic developing agents and/or benzotriazole derivatives (f) and, optionally, quaternary ammonium compounds (g). Those preparations are particularly suitable which contain 2,3-dimethyl-, 2,3,6-trimethyl- or 2,3,6-trimethyl-7-hydroxyquinoxaline as the component (e), hydroquinone as the component (f) and, additionally, N-hydroxyethylpyridinium chloride as the component (g).

The organic developer substances can also be added to the silver dye bleach bath in the form of, for example, so-called precursor compounds, such as acylated hydroquinones. Such precursor compounds have been described, for example, in EP-A- 84,290.

The quantitative ratios of the components (a), (b), (c), (d), (e), (f) and, optionally, (g) present in the bleach bath can vary within fairly wide limits. It is advantageous when the bleach baths for carrying out the method according to the invention contain (a) a sufficient quantity of a strong acid for keeping the pH value of the preparation below 2, (b) 2 to 50 g/l of a water-soluble iodide, (c) optionally 1 to 30 g/l of a water-soluble organic nitro compound, (d) 0.5 to 10 g/l of an anti-oxidising agent, (e) 0.2 to 5 g/l of a bleach catalyst, (f) 0.1 to 10 g/l of an organic developing agent and/or a benzotriazole derivative and, optionally, (g) 0.1 to 5 g/l of a quaternary ammonium salt.

The pH value of the dye and silver bleach bath should be below 2, and this can readily be ensured by the strong acid (a) already mentioned. The temperature of the bleach bath, and that of the other treatment baths, can be 20° to 90° C. In general, it is advantageous not to exceed 60° C. and to work at, for example, 30° to 40° C. However, it is a further advantage of the method that, at an elevated temperature, for example at 50° C. and higher, it still gives good images with normal colour balance. Processing can be further shortened by the increase in temperature, and the baths still remain stable for a sufficiently long period even under these conditions.

In general, the preparations required for processing are used in the form of dilute aqueous solutions. The preparations can, however, also be produced in the form of a liquid, pasty or pulverulent concentrate and, due to their good stability, they can also be stored in this state for a prolonged period. For example, two liquid concentrates, in particular aqueous concentrates, are preferably used, one containing the components (a) and (c), and the other containing the remaining components (b), (d), (e) and (f), as well as optionally (g). An additional solvent, such as ethyl alcohol or propyl alcohol, ethylene glycol monomethyl or monoethylether, can be added to the latter concentrate for improving the solubility, in particular that of the component (d).

The dilute preparations suitable for processing are obtained by combining and diluting these liquid, pasty or pulverulent concentrates which represent the packaging units for the preparations according to the invention.

For silver development, baths of conventional composition can be used, for example those which contain hydroquinone and, optionally, additionally also 1-phenyl-3-pyrazolidone as the developing agent. If the silver development is carried out in the presence of compounds which are known as fluorescent brighteners, this can indirectly lead also a speeding-up of the dye and silver bleach. Examples of such compounds are heteroaromatics, such as triazines or pyrazoles linked to aromatic systems, naphthalic acid imides, diarylpyrazolines, derivatives of coumarin and carbostyril, stilbenes substituted by heterocyclic or hetero-aromatic and aromatic systems, and in particular 4,4'-diaminostilbene-2,2'-disulfonic acids substituted by cyanuric acid derivatives.

The fixing bath can be composed in the known and usual manner. An example of a suitable fixer is sodium thiosulfate or, preferably, ammoniumthiosulfate, optionally with additions of sodium bisulfite and/or sodium metabisulfite.

All the baths can also contain additives, such as hardeners, wetting agents, fluorescent brighteners and UV absorbers. Washing steps are preferably carried out between the processing stages.

A repeat of individual treatments (each time in a further tank with a bath of the same composition as that in the preceding bath) is possible; in some cases, this can lead to better bath utilisation.

In this case also, it is advantageous to insert water baths between baths of different action.

The advantages of the method according to the invention are that both the silver bleach and the dye bleach are speeded up, the ratio of the rates of the two reactions being preserved.

The method according to the invention can be used, for example, in the production of positive colour images in automatic printing apparatus or automatic photobooths or in the rapid processing of other silver dye bleach materials, for example for scientific records, such as coloured display screen photography, and industrial purposes.

In the automatic processing of exposed silver dye bleach materials, the residence times of the silver dye bleach material in the developer bath, bleach bath and fixing bath are usually equal, and the times for the developing step and fixing step have to match the time for the bleaching step (as the longest process). The time required for developing and fixing can be shortened virtually without problems. With the reduction, now achievable according to the invention, in the time for the dye and silver bleach, the total processing time from developing to fixing can now be markedly shortened. Because the treatment times in the individual treatment stages are equal for technical reasons, the time saving for the overall process can be taken as three times the reduction achieved in the bleaching time. This is of essential importance for automatic processing.

The silver dye bleach material used can be transparent, metallic-reflecting or, preferably, white-opaque material.

The base can, for example, consist of cellulose triacetate or polyester, which may be pigmented. If it consists of paper felt, both sides of the latter must be lacquered or coated with polyethylene. The light-sensitive layers are located on at least one side of this base, preferably in the known arrangement, that is to say a redsensitised silver halide emulsion layer containing a cyan azo dye at the bottom, on top of this is green-sensitised silver halide emulsion layer containing a magenta azo dye and, at the top, a blue-sensitive silver halide emulsion layer containing a yellow azo dye. The material can also contain subbing layers, interlayers, filter layers and protective layers.

The silver dye bleach materials to be processed according to the invention can also have arrangements of silver halide and dye, which are in part spatially separate, as is described, for example, in EP-A- 39,313.

The examples which follow illustrate the invention, without restricting it thereto.

EXAMPLE 1

A silver dye bleach material is prepared which, on a pigmented cellulose triacetate base, contains a layer of red-sensitive silver bromide gelatine emulsion with a cyan dye of the formula

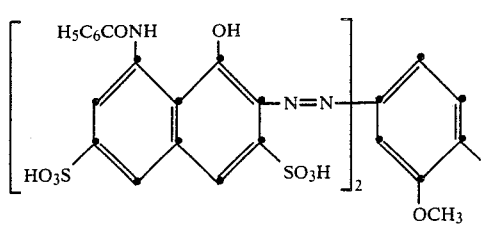

(100)

a gelatine interlayer, a layer of a green-sensitive silver bromide gelatine emulsion with a magenta dye of the formula

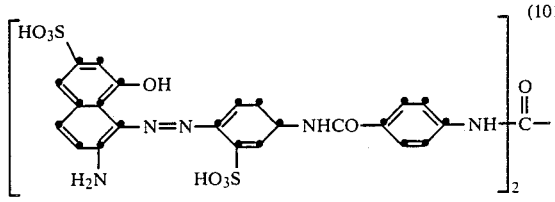

(101)

a gelatine interlayer and a layer of a blue-sensitive silver bromide gelatine emulsion with a yellow dye of the formula

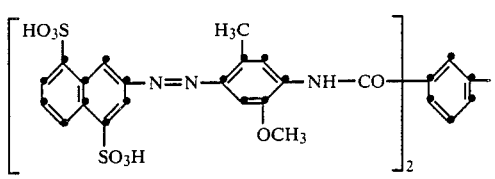

(102)

The reflection density of the incorporated image dyes is 2.0, the image dye layers contain 0.8 g/m$^2$ of silver, and the total thickness of the photographic material produced is 15 $\mu$m.

This material is exposed and processed by the immersion process. In the latter, it passes through the processing stages of developing (30 seconds), washing (10 seconds), bleaching (see Table 2 which follows), washing (10 seconds), fixing (30 seconds) and final washing (60 seconds), the temperature of the respective processing baths being 35° C.

The bleaching times listed in Table 2 which follows are those times which are necessary for bleaching the material down to a reflection density of at most 0.03 (above fog) in exposed, that is to say white, image areas.

The aqueous developer bath contains, per liter, 10 g of hydroquinone, 2 g of 1-phenylpyrazolidinone, 40 g of sodium sulfite (anhydrous), 25 g of potassium carbonate, 10 g of potassium bicarbonate, 2.5 g of potassium bromide and 0.6 g of benzotriazole. The fixing bath contains, per liter of aqueous solution: 220 g of ammoniumthiosulfate, 10 g of sodium metabisulfite and 40 g of sodium sulfite.

The bleach baths Nos. 3 to 8 according to the invention, the Table 2 and the comparative bleach baths No. 1 and 2 contain, per liter of aqueous solution, 50 g of concentrated sulfuric acid, 2 g of 4-mercaptobutyric acid, 10 g of potassium iodide, 7 g of sodium m-nitrobenzene-sulfonate) 2 g of bleach catalyst and the additions indicated in the table.

TABLE 2

| No. | Additions to the bleach bath | Bleach catalyst | Bleach time (seconds) |
|---|---|---|---|
| 1 (comparison) | none | 2,3,6-trimethylquinoxaline | 50 |
| 2 (comparison with DE-A 2,716,136) | 2 g of N—hydroxyethylpyridinium chloride | 2,3,6-trimethylquinoxaline | 40 |
| 3 | 4 g of 1-phenyl-4-methyl-4'-hydroxymethyl-pyrazolidin-3-one | 2,3,6-trimethyl quinoxaline | 35 |
| 4 | 4 g of 1-phenyl-4-methyl-pyrazolidin-3-one | 2,3,6-trimethylquinoxaline | 35 |
| 5 | 6 g of hydroquinone and 2 g of N—hydroxyethyl-pyridinium chloride | 2,3,6-trimethylquinoxaline | 30 |
| 6 | 6 g of hydroquinone and 2 g of N—hydroxyethyl-pyridinium chloride | 2,3-dimethylquinoxaline | 30 |
| 7 | 6 g of hydroquinone and 2 g of N—hydroxyethyl-pyridinium chloride | 0.7 g of 2,3,6-trimethylquinoxaline and 1.3 g of 2,3,6-trimethyl-7-hydroxyquinoxaline | 30 |
| 8 | 6 g of benzotriazole and 4 g of 1-phenylpyrazolidin-3-one | 2,3,6-trimethylquinoxaline | 30 |

The speeding-up of bleaching obtained by these additions is surprising and exceeds even the speeding-up of bleaching, obtained with quaternary ammonium salts as described in DE-A No. 2,716,136.

Similar effects are also obtained with, for example, other bleach catalysts according to formula (1) and additions of formulae (4) to (9).

EXAMPLE 2

A silver dye bleach material is prepared which, on a white-opaque cellulose triacetate base, contains a red-sensitive silver bromide-iodide emulsion layer, a red-sensitive silver bromide-iodide emulsion layer containing a cyan dye of the formula (100), a gelatine interlayer, a green-sensitive silver bromide-iodide emulsion layer containing a magenta dye of the formula (101), a green-sensitive silver bromide-iodide emulsion layer, a yellow filter layer (40 mg/m$^2$ of a yellow silver hydrosol), a blue-sensitive iodide-free silver bromide emulsion layer containing a yellow dye of the formula (102), a blue-sensitive iodide-free silver bromide emulsion layer and a protective gelatine layer. A gelatine layer is coated on the back of the base.

The iodide-containing emulsion layers contain silver halide crystals with 2.6 mole % of silver iodide and 97.4 mole % of silver bromide. The image dyes are used in such a concentration that the reflection density of each of them is 2.0; the total silver content of the 22 $\mu$m thick layers is 2.0 g/m$^2$.

This material is exposed and processed by the immersion process. In the latter, it passes through the processing stages of developing (2minutes), washing (2minutes), bleaching (see Table 3 which follows), washing (2 minutes), fixing (5 minutes) and final washing (5 minutes), the temperature of the respective processing baths being 24° C.

The bleaching times indicated in Table 3 which follows are those times which are necessary for bleaching the material down to a reflection density of at most 0.03 (above fog) at exposed, that is to say white image areas.

The aqueous developer bath contains, per liter:

Sodium ethylenediaminetetraacetate: 2.0 g
Potassium sulfite: 24.4 g
1-Phenyl-4-methylpyrazolidinone: 2.5 g
Hydroquinone: 8.3 g
Potassium metaborate: 16.3 g
Boric acid: 1.0 g
Potassium bromide: 1.7 g
Benzotriazole: 0.3 g
Ethylcellosolve: 100 g
2,3,6-Trimethylquinoxaline: 0.3 g
Ascorbic acid: 8.3 g
Sodium thiosulfate, anhydrous: 0.9 g The aqueous bleach baths 1 to 5 in Table 3 contain, per liter:

140 g of sulfamic acid
6 g of sodium m-nitrobenzenesulfonate
56 g of ethylcellosolve
2 g of 2,3,6-trimethylquinoxaline
6 g of potassium iodide
1 g of 4-mercaptobutyric acid and the additions shown in Table 3.

TABLE 3

| No. | | Additions to the bleach bath | Bleach time (seconds) |
|---|---|---|---|
| 1 (Comparison) | | none | 360 |
| 2 | Comparison with DE-A-2716136 | 4 g of N—methylpyridinium iodide | 180 |
| 3 | | 2 g of the compound of the formula (103) | 210 |
| 4 | | 4 g of N—methypyridinium iodide and 3 g of benzotriazole | 120 |
| 5 | | 2 g of the compound of the formula (103) and 3 g of benzotriazole | 120 |

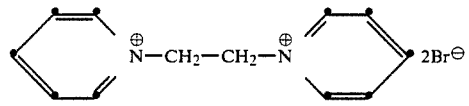

(103)

The results in Table 3 show that the additions, according to the invention, to the bleach bath effect a marked shortening of the bleach time.

Similar results are also obtained with other catalysts of the formula (1) and additions of the formulae (4) to (9).

EXAMPLE 3

This Example illustrates the shortening of the total processing time of exposed silver dye bleach materials, which shortening is composed of the time-saving achieved according to the invention in the combined dye and silver bleach, and the time-saving achievable by known measures in development and fixing.

The processing of exposed silver dye bleach materials conventionally takes place, for example, in a developer bath according to Example 1, a bleach bath according to Table 2, No. 1, and a fixing bath according to Example 1 at a processing temperature of 35° C. In this method, the total duration of processing is 4 minutes and 20 seconds (1 minute each in the developer, bleach and fixing baths, 1 minute for final washing and 20 seconds for intermediate washing).

If, however, a developer which, per liter of aqueous solution, contains 15 g of hydroquinone, 2 g of 1-phenylpyrazolidone, 40 g of sodium sulfite (anhydrous), 25 g of potassium carbonate, 10 g of potassium bicarbonate, 2 g of potassium bromide, 0.1 g of benzotriazole and 3 g of sodium ethylenediaminetetraacetate, a bleach bath according to Table 2, Nos. 5 to 8, and a fixing bath containing 250 g of ammonium thiosulfate, 50 g of potassium metabisulfite and 19 g of potassium hydroxide per liter of aqueous solution are then used, and if an intermediate washing for 10 seconds after bleaching and a final washing for 1 minute are carried out, the resulting total processing time at a bath temperature of 35° C. is only 2 minutes and 40 seconds, since each of developing, bleaching and fixing takes only 30 seconds. This means a time-saving of 1 minute and 40 seconds, as compared with conventional processing methods.

Such processing methods are important above all for the production of photographic images in automatic photo-booths.

What is claimed is:

1. A method for processing silver dye bleach materials by the process steps of silver development, dye and silver bleaching, and fixing, which comprises using, for the combined dye and silver bleach, a preparation which contains (a) a strong acid in an amount sufficient to maintain the pH value of the preparation below 2, (b) 2 to 50 g/l of a water-soluble iodide, (c) 1 to 30 g/l of a water-soluble organic nitro compound, (d) 0.5 to 10 g/l of an anti-oxidising agent, (e) 0.2 to 5 g/l of a bleach catalyst, (f) 0.1 to 10 g/l of an organic developing agent and/or a benzotriazole derivative.

2. A method according to claim 1, wherein the preparation additionally contains (g) a quaternary ammonium salt.

3. A method according to claim 2, wherein component (g) is of the formulae

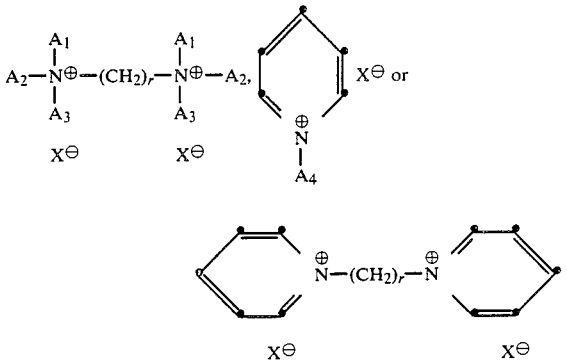

in which $A_1$, $A_2$ and $A_3$ independently of one another are alkyl each having 1 to 4 carbon atoms, $A_4$ is methyl, ethyl, hydroxymethyl or hydroxyethyl, $X^{\ominus}$ is a halide and r is 2 to 12.

4. A method according to claim 3, wherein component (g) is of the formula

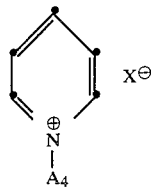

in which $A_4$ and $X^{\ominus}$ are as defined in claim 3.

5. A method according to claim 2, wherein the preparation contains 2,3-dimethyl-, 2,3,6-trimethyl- or 2,3,6-trimethyl-7-hydroxy-quinoxaline as the component (e), hydroquinone as the component (f) and, additionally, N-hydroxyethyl-pyridinium chloride as the component (g).

6. A method according to claim 1, wherein component (a) is sulfuric acid or sulfamic acid.

7. A method according to claim 1, wherein component (b) is sodium iodide or potassium iodide.

8. A method according to claim 1, wherein component (c) is a water-soluble aromatic nitro compound.

9. A method according to claim 8, wherein component (c) is a nitrobenzenesulfonic acid.

10. A method according to claim 1, wherein component (d) is a reductone or a mercapto compound.

11. A method according to claim 10, wherein component (d) is ascorbic acid or a mercaptocarboxylic acid.

12. A method according to claim 11, wherein component (d) is of the formula $HS—(CH_2)_m—COOH$, in which m is 3 or 4.

13. A method according to claim 1, wherein component (e) is a quinoxaline of the formula

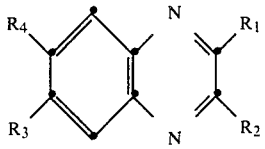

in which $R_1$ and $R_2$ independently of one another are hydrogen, alkyl having 1 to 5 carbon atoms, a radical of the formula $—CH_2—X$, in which X is hydroxyl, halogen, acyloxy or alkoxy having 1 to 4 carbon atoms, or phenyl, and $R_3$ and $R_4$ independently of one another are hydrogen, alkyl having 1 to 5 carbon atoms, alkoxy having 1 to 4 carbon atoms, hydroxyl, halogen, amino, acylamino or a sulfonic acid group or together form a radical of the formula $—O—(CH_2)_p—O—$, in which p is 1 or 2.

14. A method according to claim 13, wherein component (e) is a quinoxaline of the formula

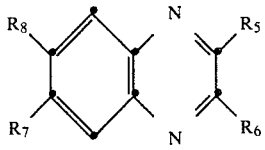

in which $R_5$ and $R_6$ independently of one another are alkyl having 1 to 5 carbon atoms, $—CH_2OH$, $—CH_2CL$ or phenyl, and $R_7$ and $R_8$ independently of one another are hydrogen, alkyl having 1 to 5 carbon atoms, alkoxy having 1 to 4 carbon atoms, hydroxyl or amino.

15. A method according to claim 14, wherein component (e) is a quinoxaline of the formula

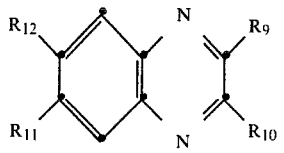

in which $R_9$ and $R_{10}$ are alkyl having 1 to 5 carbon atoms, and $R_{11}$ and $R_{12}$ indepndently of one another are hydrogen, alkyl having 1 to 5 carbon atoms or hydroxyl.

16. A method according to claim 1, wherein component (f) is a hydroquinone derivative or pyrazolidinone derivative.

17. A method according to claim 16, wherein component (f) is of the formula

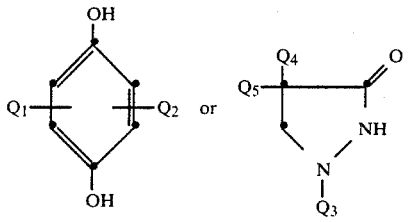

in which $Q_1$ and $Q_2$ independently of one another are hydrogen, alkyl or alkoxy each having 1 to 4 carbon atoms or halogen, $Q_3$ is phenyl or phenyl substituted by alkyl or alkoxy each having 1 to 4 carbon atoms, and $Q_4$ and $Q_5$ independently of one another are hydrogen, alkyl or hydroxyalkyl each having 1 to 4 carbon atoms.

18. A method according to claim 17, wherein component (f) is hydroquinone or a compound of the formula

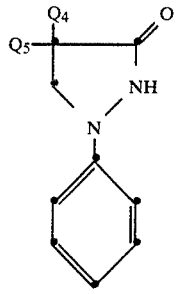

in which $Q_4$ and $Q_5$ independently of one another are hydrogen, methyl or hydroxymethyl.

19. A method according to claim 1, wherein component (f) is benzotriazole or a benzotriazole derivative of the formula

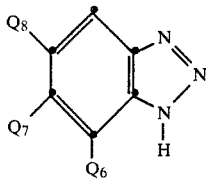

in which $Q_6$ is hydrogen or alkyl having 1 to 4 carbon atoms, $Q_7$ is hydrogen, alkyl or alkoxy each having 1 to 4 carbon atoms, $—SO_3H$ or $—SO_2NH_2$, and $Q_8$ is hydrogen, alkyl having 1 to 4 carbon atoms or halogen.

20. A preparation for carrying out the dye and silver bleach by the method according to claim 1, which contains (a) a sufficient quantity of a strong acid for keeping the pH value of the preparation below 2, (b) 2 to 50 g/l of a water-soluble iodide, (c) 1 to 30 g/l of a water-soluble organic nitro compound, (d) 0.5 to 10 g/l of an anti-oxidising agent, (e) 0.2 to 5 g/l of a bleach catalyst, (f) 0.1 to 10 g/l of an organic developing agent and/or a benzotriazole derivative and, optionally, (g) 0.5 to 5 g/l of a quaternary ammonium salt.

21. A preparation according to claim 20, which is produced from a concentrate containing components (a) and (c) and from a concentrate containing components (b), (d), (e) and (f) and, optionally, (g) by dilution with water, optionally mixed with an organic solvent.

22. A packaging unit for the preparation according to claim 21, which comprises two separate liquid, pasty or pulverulent concentrates, one containing the components (a) and (c) and the other containing the components (b), (d), (e), (f) and, optionally, (g).

* * * * *